United States Patent [19]

Iida et al.

[11] Patent Number: 4,884,535

[45] Date of Patent: Dec. 5, 1989

[54] STARTING SYSTEM FOR INTERNAL COMBUSTION ENGINE

[75] Inventors: Giichi Iida; Taketomo Kodama, both of Tokyo, Japan

[73] Assignee: Kioritz Corporation, Tokyo, Japan

[21] Appl. No.: 268,961

[22] Filed: Nov. 9, 1988

[30] Foreign Application Priority Data

Nov. 11, 1987 [JP] Japan ..... 62-172207[U]

[51] Int. Cl.[4] ..... F02N 3/02; F02N 5/02; F02N 11/00

[52] U.S. Cl. ..... 123/179 P; 123/185 B; 290/47

[58] Field of Search ..... 123/179 P, 179 D, 179 SE, 123/185 B, 185 BA; 74/625; 290/47

[56] References Cited

U.S. PATENT DOCUMENTS

| | | | |
|---|---|---|---|
| 1,990,306 | 2/1935 | Nardone | 123/179 D |
| 2,508,833 | 5/1950 | Metsger | 74/625 |
| 2,865,358 | 12/1958 | Musgrave | 123/179 SE |
| 2,939,448 | 6/1960 | Hansen | 123/170 P |
| 3,219,021 | 11/1965 | Mercer et al. | 123/179 P |
| 3,747,649 | 7/1973 | Denslow et al. | 123/185 BA |
| 3,774,303 | 11/1973 | Burkett et al. . | |
| 3,783,851 | 1/1974 | Sherwood et al. . | |
| 4,157,083 | 6/1979 | Smith et al. | 123/179 P |
| 4,582,030 | 4/1986 | Reese | 123/185 BA |

FOREIGN PATENT DOCUMENTS 63-79471 5/1988 Japan .

*Primary Examiner*—Willis R. Wolfe
*Assistant Examiner*—M. Macy
*Attorney, Agent, or Firm*—Browdy and Neimark

[57] ABSTRACT

A starting system for an internal combustion engine wherein an output shaft of a reduction device of an automatic starter is arranged into and passing through an axial bore formed in a boss portion supporting a recoil drum of a recoil-type manual starter, and a second connecting member of a clutch device is arranged on the output shaft in such a manner that the second connecting member can be shifted axially to engage or disengage with respect to a first connecting member of the clutch device.

2 Claims, 1 Drawing Sheet

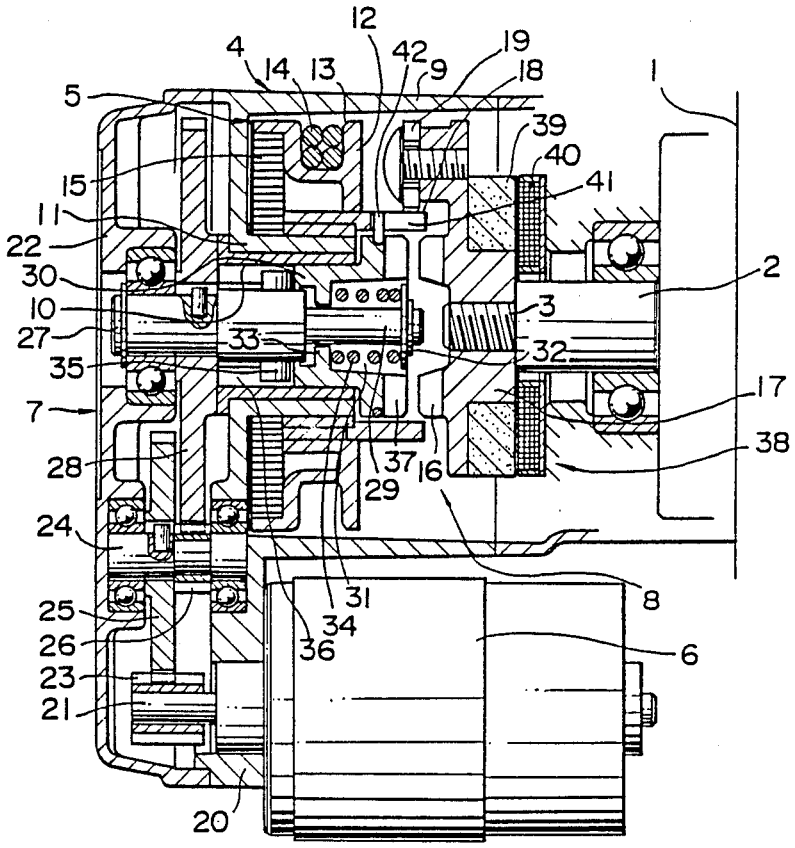
12
4
14
13
42
9
19
18
1
5
39
40
15
41
11
22
2
30
3
10
27
33
32
35
17
7
38
28
37
16
29
24
8
31
25
34
26
36
6
23
21
20

STARTING SYSTEM FOR INTERNAL COMBUSTION ENGINE

BACKGROUND OF THE INVENTION

This invention relates to a starting system adapted to be used with an internal combustion engine of a portable working machine.

It is important that, for example, portable working machines such as bush cutters, chain saws and the like are so constructed as to be compact, light and small-sized. To this end, generally, in conventional internal combustion engines for portable working machines, recoil-type manual starters have been used as starting systems for actuating the engines. Recently, a starting system including both the recoil-type manual starter and an automatic starter to facilitate the starting operation of the starting system has been required. A conventional starting system proposed to satisfy such requirements was large-sized and was unsuitable to adopt to portable working machines and the like. Further, in the conventional starting system, when a generator was incorporated into the system to obtain a charging function and the like, the construction of the system was more complicated to make the assembling and maintenance of the starting system still difficult.

SUMMARY OF THE INVENTION

Accordingly, an object of the present invention is to provide a starting system for an internal combustion engine wherein both a recoil-type manual starter and an automatic starter are provided for facilitating the starting operation of the system, these starters are arranged in compact fashion to facilitate the assembling, maintenance and/or inspection of the system, and which can eliminate the above-mentioned drawback of the conventional starting system.

According to the present invention, a starting system for an internal combustion engine is characterized in that one of connecting members of a clutch device is fixedly mounted on a crankshaft of an internal combustion engine; a ratchet pawl member engaging with an engagement member attached to a recoil drum of a recoil-type manual starter is mounted on said one connecting member; a boss portion supporting said recoil drum of the recoil-type manual starter is provided with an axial bore; an output shaft of a reduction device of an automatic starter is arranged into and passing through said axial bore; and an other connecting member of the clutch device is arranged on said output shaft so that said an other connecting member can shift axially to engage or disengage with respect to said one connecting member.

Accordingly, the recoil-type manual starter and the output shaft of the reduction device of the automatic starter are concentrically arranged, and the recoil drum of the recoil-type manual starter and the connecting member associated with the output shaft of the reduction device of the automatic starter are arranged in confronting relation to the same connecting member, whereby only one of the starter which is activated can be connected to the crankshaft of the internal combustion engine to start the same. That is to say, according to the present invention, the construction of the starting system can be compact, only one of the starters which is activated can be connected to the engine, and magnets of the generator can be attached to the crankshaft to rotate the magnets together with the connecting member, thus simplifying the whole construction of the system.

BRIEF DESCRIPTION OF THE DRAWINGS

An attached FIGURE is a longitudinal sectional view showing a main part of a starting system for an internal combustion engine according to a preferred embodiment of the present invention.

PREFERRED EMBODIMENT OF THE INVENTION

The present invention will now be explained in connection with an embodiment shown in the drawing.

In the embodiment shown in the FIGURE, a crankshaft 2 of an internal combustion engine 1 is connected, at its one end (not shown), to a working tool of a working machine through an appropriate transmission device (not shown) so that when the engine 1 is operated the working tool is driven by the rotation of the crankshaft 2 to effect a desired work. A starting system 4 is provided at the other end portion 3 of the crankshaft 2 of the engine 1. The starting system 4, generally, comprises a recoil-type manual starter 5, an automatic starter 6, a reduction device 7 for reducing rotational driving power from the automatic starter, and a clutch device 8 for rotational driving power from the recoil-type manual starter 5 or the automatic starter 6 to the crankshaft 2.

The recoil-type manual starter 5 includes a casing 9 attached to the engine 1, a sleeve-like boss portion 11 formed integrally with the casing 9 to extend coaxially with the crankshaft 2 toward its end portion 3 and having an axial bore 10, a recoil drum 12 rotatably supported around the boss portion 11, a starter rope 14 wound around and positioned into a circumferential groove 13 of the recoil drum 12 and having a free end (not shown) extending outside the casing 9, and a recoil spring 15 for biasing the recoil drum 12 to take up or wind up the starter rope 14 into the circumferential groove 13. The clutch device 8 includes a first disc-like connecting member 17 fixed to the end portion 3 of the crankshaft 2 and being provided, at its front face, with a connecting tooth 16, a tubular engagement member 18 attached to the recoil drum 12 of the recoil-type manual starter 5 and extending axially toward the first connecting member 17, a ratchet pawl member 19 eccentrically pivoted on the first connecting member 17 for transmitting rotational force of the recoil-type manual starter 5 to the crankshaft 2 to start the engine when engaged by the engagement member 18. When the internal combustion engine 1 is started by means of the recoil-type manual starter 5, an operator pulls the starter rope 14 outside the casing 9 against the action of the recoil spring 15, thereby rotating the recoil drum 12. The rotational force of the recoil drum 12 is transmitted to the first connecting member 17 through the engagement member 18 and the ratchet pawl member 19, thereby rotating the crankshaft 2, thus starting the engine 1. When the number of revolutions of the crankshaft 2 is increased, the ratchet pawl member 19 is automatically disengaged from the engagement member 18 under the action of centrifugal force exerted on the pawl member 19.

In the illustrated embodiment, the automatic starter 6 may be an electric motor. In this case, the motor is arranged below the casing 9 and an output end of the motor is fixed to a lower protruding portion 20. A motor shaft 21 of the automatic starter 6 is arranged to extend in the same direction as and parallel with the end portion 3 of the crankshaft 2.

The reduction device 7 is arranged axially outside the casing 9. The reduction device 9 includes a cover casing 22 attached to the casing 9, a first pinion 23 attached to the motor shaft 21 of the automatic starter 6, a first large gear 25 attached to an intermediate shaft 24 rotatably supported by the casing 9 and the cover casing 22 and meshed with the first pinion 23, a second pinion 26 attached to the intermediate shaft 24, and a second large gear 28 attached to an output shaft 27 rotatably supported by the cover casing 22 and meshed with the second pinion 26. The output shaft 27 has a forward portion 29 which is positioned nearer to the end portion 3 of the crankshaft 2 and which extends through the axial bore 10 of the boss portion 11 of the casing 9 of the recoil-type manual starter 5 and protrudes from the bore 10 toward the first connecting member 17 of the clutch device 8. A second connecting member 30 of the clutch device 8 is freely received into the axial bore 10 of the boss portion 11 of the casing 9 and is slidably mounted on the forward portion 29 of the output shaft 27 in such a manner that the second connecting member 30 can shift axially to engage with the first connecting member 17 of the clutch device 8. The second connecting member 30 has a forwardly flared axial cavity 31 and an annular ridge 33 projecting radially inwardly from the inner surface of the second connecting member 30, and is biased, by means of a compression spring 34 positioned between the ridge 33 and a washer 32 fixed to a free end of the forward portion 29 of the output shaft 27, toward a clutch release position where the second connecting member 30 is separated axially from the first connecting member 17. In this clutch release position, as shown in the FIGURE, the second connecting member 30 is held against projection pins 35 of the output shaft 27. Further, the second connecting member 30 is provided, at its axial outer end portion, with pin guiding recesses 36 into which the projection pins 35 of the output shaft 27 are received. When the output shaft 27 is rotated in a direction to start the engine, the projection pins 35 are rotated along the pin guiding recesses 36, whereby the second connecting member 30 is moved toward the first connecting member 17 in the same manner as a bendix gear, thus engaging teeth 37 formed on the second connecting member 30 with the teeth 16 of the first connecting member 17.

When the engine 1 is started by means of the automatic starter 6, the automatic starter 6 is energized by a battery and the like (not shown) to rotate the motor shaft 21. The rotational force of the motor shaft 21 is transmitted, through the first pinion 23 of the reduction device 7, the first large gear 25, the second pinion 26 and the second large gear 28, to the output shaft 27 to rotate the latter. Consequently, as mentioned above, due to the rotation of the projection pins 35 in the pin guiding recesses 36, the second connecting member 30 is shifted from the clutch release position (as shown) to the clutch engaging position where the second connecting member 30 is engaged by the first connecting member 17, thus rotating the crankshaft 2 to start the engine 1. After the engine 1 is started, when the automatic starter 6 is disenergized, the second connecting member 30 is automatically returned to the clutch release position under the action of the compression spring 34, thus disengaging the second connecting member 30 from the first connecting member 17.

Incidentally, in the illustrated embodiment, in order to assure that the second connecting member 30 can positively be shifted in the axial direction when the output shaft 27 is rotated, a ring spring is loosely mounted around an inner end portion of the second connecting member 30 and a bent end 42 of the ring spring is inserted into a slit 41 formed in the engagement member 18.

Further, magnets 39 of a generator 38 one fixedly mounted on a rear face of the first connecting member 17 of the clutch device 8. The magnets 39 can be rotated together with the first connecting member 17 and the crankshaft 2. The generator 38 is provided with stator windings 40 adjacent to the magnets 39. The stator windings 40 generate electric current as the magnets 39 are rotated, the generated electric current being supplied to the battery to charge.

What is claimed is:

1. A starting system for an internal combustion engine, wherein one of connecting members of a clutch device is fixedly mounted on a crankshaft of said internal combustion engine, a ratchet pawl member which engages with an engagement member attached to a recoil drum of a recoil-type manual starter being mounted on said one connecting member, an axial bore being formed in a boss portion supporting said recoil drum of said recoil-type manual starter, an output shaft of a reduction device of an automatic starter being arranged into said axial bore to pass through said axial bore, an other connecting member of said clutch device being arranged on said output shaft in such a manner that said other connecting member can be shifted axially to engage or disengage with respect to said one connecting member.

2. A starting system as set forth in claim 1, wherein a generator is constituted by magnets fixed to a rear face of said one connecting member to rotate together with said crankshaft and stator windings arranged adjacent said magnets, and electric current is generated in said stator windings as said magnets are rotated, to use for charging a battery.

* * * * *